US007150702B2

(12) United States Patent
Webb et al.

(10) Patent No.: US 7,150,702 B2
(45) Date of Patent: Dec. 19, 2006

(54) LEG CURL/LEG EXTENSION WEIGHT TRAINING MACHINE

(75) Inventors: Gregory M. Webb, Independence, VA (US); Michael Wayne Morris, Galax, VA (US)

(73) Assignee: Nautilus Human Performance Systems, Inc., Independence, VA (US)

( * ) Notice: Subject to any disclaimer, the term of this patent is extended or adjusted under 35 U.S.C. 154(b) by 731 days.

(21) Appl. No.: 10/186,433

(22) Filed: Jul. 1, 2002

(65) Prior Publication Data

US 2004/0002409 A1 Jan. 1, 2004

(51) Int. Cl.
*A63B 21/00* (2006.01)

(52) U.S. Cl. ..... 482/130; 482/142; 482/93

(58) Field of Classification Search ..... 482/100, 482/137, 138, 99, 142, 95, 96, 130, 104, 482/103, 97, 133
See application file for complete search history.

(56) References Cited

U.S. PATENT DOCUMENTS

| | | | | |
|---|---|---|---|---|
| 4,634,127 | A | 1/1987 | Rockwell | 272/134 |
| 4,861,025 | A * | 8/1989 | Rockwell | 482/142 |
| 5,002,271 | A | 3/1991 | Gonzales | 272/134 |
| 5,042,801 | A | 8/1991 | Sterba et al. | 272/144 |
| 5,060,939 | A * | 10/1991 | Oswald et al. | 482/142 |
| 5,069,447 | A * | 12/1991 | Snyderman et al. | 482/133 |
| 5,395,295 | A | 3/1995 | Ish, III | 482/100 |
| 5,669,865 | A * | 9/1997 | Gordon | 482/142 |
| 6,090,020 | A * | 7/2000 | Webber | 482/100 |
| 6,319,178 | B1 | 11/2001 | Webber | 482/100 |

OTHER PUBLICATIONS

Nautilus brochure "Personal Circuit" *Multi=Station Gym* (1999).
Precor Move Beyond "S3.45 Strength Training System" www.precor.com.
Precor Move Beyond "S3.45 Strength Training System".
Precor: Strength Products—Malibu; "Malibu Single Stock Multi-Function Home System" (Sep. 26, 2000) htpp://www.pacificfitness.com/strength/broc_Malibu.htm.

* cited by examiner

*Primary Examiner*—Jerome W. Donnelly
(74) *Attorney, Agent, or Firm*—Myers Bigel Sibley & Sajovec

(57) ABSTRACT

An exercise machine for performing leg curl and leg extension movements includes: a frame configured to rest on an underlying surface; an upper leg-supporting assembly pivotally interconnected with the frame, the upper leg-supporting assembly having a seat pad; a torso-supporting assembly pivotally interconnected with the frame and with the upper leg-supporting assembly, the torso-supporting assembly having a backrest pad; a leg curl assembly arm pivotally interconnected with the frame about a first pivot axis; a leg extension assembly arm pivotally interconnected with the frame about a second pivot axis; a resistance-imparting unit coupled with the leg curl movement arm and the leg extension movement arm; and a conversion mechanism interconnected with the frame and/or the torso-supporting assembly and the upper leg-supporting assembly. The conversion mechanism moves the torso-supporting assembly and the upper leg-supporting assembly between a leg extension position, wherein the seat pad and the backrest pad combine to form a backrest and seat for a seated exerciser, and the second pivot axis is positioned in front of a front edge of the seat pad, and a leg curl position, wherein the seat pad and backrest pad combine to form a curl platform for a prone exerciser, and the first pivot is positioned above a plane defined by an upper surface of the seat pad.

26 Claims, 4 Drawing Sheets

108b
100
102
108a
10
110
TO WEIGHT STACK
67
64
63
62
60
67
A1
48
P
50
22
58
54
92
42
40
41
46
20
52
68
α1
55
56
90
33
44
38
32
36
30
34
24
66
65
106
86
84
104a
18
104b
104c
76
15
80
72
88
70
74
16
14
12

LEG CURL/LEG EXTENSION WEIGHT TRAINING MACHINE

FIELD OF THE INVENTION

The present invention relates generally to exercise equipment, and relates more particularly to weight training equipment.

BACKGROUND OF THE INVENTION

Exercise devices, and in particular weight training machines, typically include a mechanical member that the user repeatedly moves along a prescribed path for exercise. Conventionally, movement of the mechanical member is resisted in some fashion (often by weights) to render the movement more difficult and thereby intensify the exercise. The movement of the mechanical member determines what muscle or muscle groups are to be involved in the exercise.

One popular exercise movement is the leg curl, which involves bending the legs from an extended position, in which the legs are straight, to a curl position, in which they are bent at the knees at approximately a ninety degree angle. This movement can be performed as the exerciser is seated, standing (this is less common), or, more commonly, as the exerciser is prone. In the prone position, the user is often bent somewhat at the waist (at an angle of between about 5 and 30 degrees). Generally, the leg curl movement exercises the hamstring and, to a lesser extent, the gluteus maximus muscles of the exerciser, and the aforementioned bent position of the exerciser can promote complete contraction of the hamstrings.

Another common exercise movement is the leg extension, which generally can be regarded as the opposing, or reverse, movement of the leg curl. More specifically, the exerciser moves his legs from a position in which the legs are bent at the knees at an angle of approximately ninety degrees to an extended position in which the legs are straight. The leg extension movement, which is typically performed as the user is seated, exercises the quadriceps muscles of the user.

Because the movements are similar, some exercise machines that enable the exerciser to perform either movement have been designed. Such machines can save cost and space; this can be particularly important for multi-station exercise machines, as having a single station that can provide both leg curl and leg extension capability eliminates the need to have either of these movements provided by a different station. One difficulty faced by designers is creating a configuration that properly positions the pivot axes of the leg curl and leg extension movements. Ideally, the pivot axis of the curl and extension movement arms would be coincident with the pivot axis of the knee joint, which is typically at a location just inside the dorsal surface of the knee when the leg is extended. If these pivot axes are not properly positioned, the exercise can place stress on the knee joint.

One exemplary machine is the PERSONAL CIRCUIT machine, available from Nautilus HPS, Inc., which is designed for a seated exerciser for both movements. This machine has two movement arm positions: one for the leg curl movement that is at rest at approximately the height of the seat; and another for the leg extension movement that is at rest in a position directly below the front edge of the seat (typically, the movement arm is repositioned relative to other parts of a single overall assembly). However, this type of machine requires that the resistance to the movement arm motions be directed upwardly for the leg curl movement and downwardly for the leg extension movement. As such, this machine employs some additional components (pulleys, cables, cams, or the like) that can redirect the direction of resistance in order for its single weight stack to provide resistance for both movements; these additional components typically add cost to the machine. In addition, there can be a reduced range of motion for the leg curl for a seated leg curl. Further, when the exerciser is performing a seated leg curl, the weight of the lower leg itself assists, rather than resists, the movement, thereby requiring that the machine provide a higher load for the same degree of exercise resistance.

Another leg curl/leg extension machine configuration is exemplified in U.S. Pat. No. 5,002,271 to Gonzales. In the machine illustrated therein, a hinged bench has a generally horizontal seat and generally vertical backrest for a leg extension movement; these convert to a flat horizontal platform for a prone leg curl movement. The machine includes a single assembly for the leg curl and leg extension arms that is pivoted at the front edge of the "seat". This pivot location is, for the reasons set forth above, a biomechanically disfavored location, as it fails to align the exerciser's knee joint with the exercise arm pivot axis for both the leg curl and leg extension movements. A similar device is illustrated in U.S. Pat. No. 5,042,801 to Sterba et al.

SUMMARY OF THE INVENTION

The present invention is directed to an exercise machine for performing leg curl and leg extension movements. The machine comprises: a frame configured to rest on an underlying surface; an upper leg-supporting assembly pivotally interconnected with the frame, the upper leg-supporting assembly having a seat pad; a torso-supporting assembly pivotally interconnected with the frame and with the upper leg-supporting assembly, the torso-supporting assembly having a backrest pad; a leg curl assembly arm pivotally interconnected with the frame about a first pivot axis; a leg extension assembly arm pivotally interconnected with the frame about a second pivot axis (which is typically coincident with the first pivot axis); a resistance-imparting unit coupled with the leg curl movement arm and the leg extension movement arm; and a conversion mechanism interconnected with the frame and at least one of the torso-supporting assembly and the upper leg-supporting assembly. The conversion mechanism is configured to move the torso-supporting assembly and the upper leg-supporting assembly between a leg extension position, in which the seat pad and the backrest pad combine to form a backrest and seat for a seated exerciser, and in which the second pivot axis is positioned in front of a front edge of the seat pad, and a leg curl position, in which the seat pad and backrest pad combine to form a curl platform for a prone exerciser, and in which the first pivot is positioned above a plane defined by an upper surface of the seat pad. In this configuration, the machine can be converted between leg curl and leg extension positions for exercise and can provide movement arms for each exercise that pivot about axes substantially coincident with the knee joint of the exerciser.

In one particular embodiment, the first and second pivot axes are coincident. In another embodiment, in the leg extension position the pivot axis of the leg extension assembly arm is postioned between 0.25 and 1 inch forwardly of the front edge of the seat pad. The backrest pad and seat pad typically form an angle of between about 150 and 170 degrees in the leg curl position and between about 100 and 120 degrees in the leg extension position.

According to certain embodiments of the invention, the conversion mechanism includes: a lifting member pivotally interconnected to the frame; a control link pivotally interconnected to the lifting member and to the upper leg-supporting assembly; a conversion pin attached to the lifting member; and a guide attached to the frame. The guide includes a leg extension slot and a leg curl slot positioned such that, when the exercise machine is in the leg extension position, the conversion pin is received in the leg extension slot, and when the exercise machine is in the leg curl position, the conversion pin is in the leg curl slot.

DETAILED DESCRIPTION OF THE INVENTION

Figure 1:
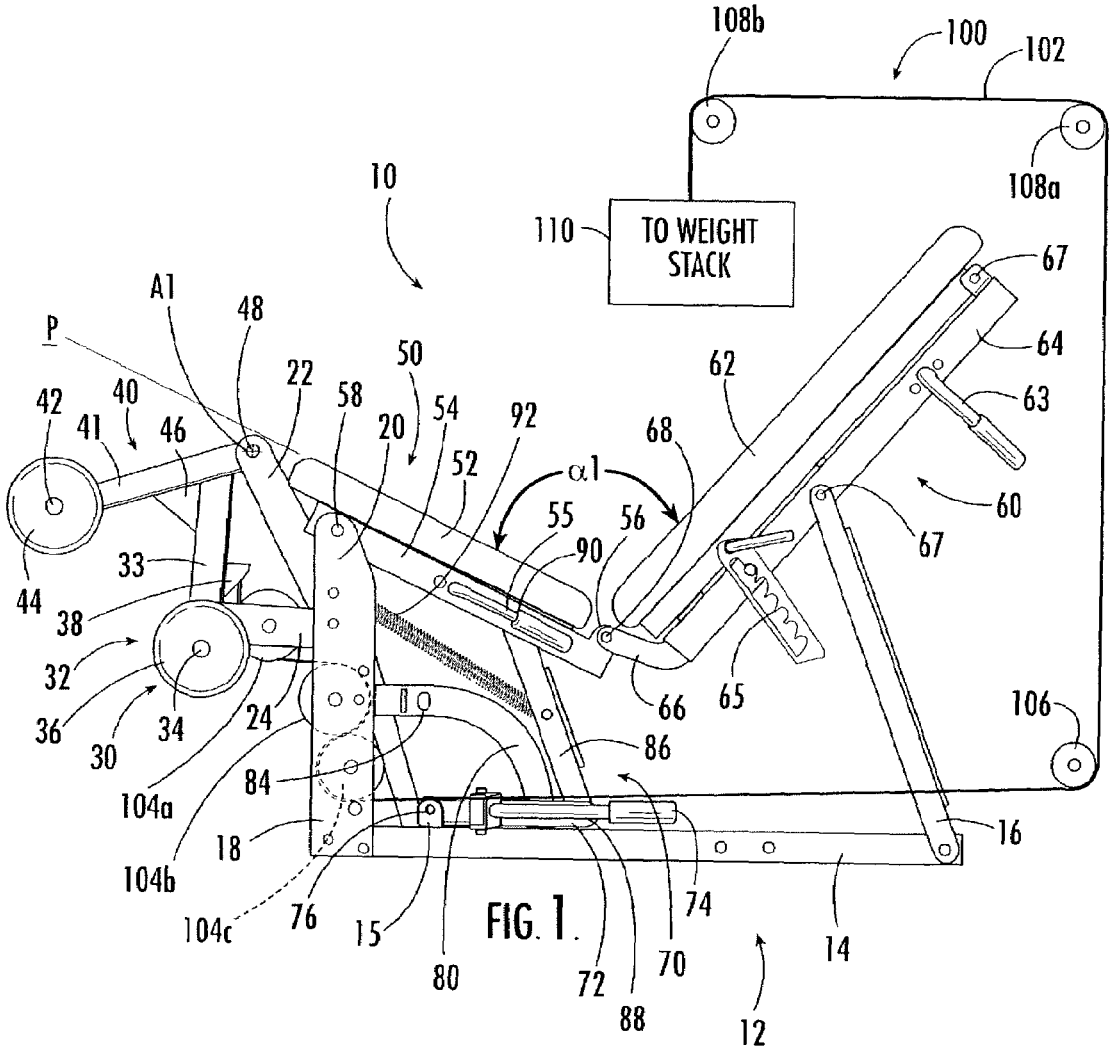
FIG. 1 is a side view of the leg curl/leg extension exercise machine of the present invention, with the machine shown in its leg extension position.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring now to the figures, a leg curl/leg extension exercise machine, designated broadly at 10, is illustrated in FIG. 1. In describing the leg curl/leg extension machine 10, it will be assumed for the purposes of description that the terms "front", "forward", and derivatives thereof refer to the horizontal direction a seated exerciser faces (i.e., to the left as shown in FIG. 1) when performing the leg extension movement. The term "rear" and derivatives thereof refer to the horizontal direction that is opposite the "forward" direction (i.e., to the right as shown in FIG. 1). Together, the "forward" and "rear" directions comprise the "longitudinal" dimension of the machine 10. The terms "outward", "outer" and derivatives thereof refer to the horizontal direction defined by a vector beginning at the center of the machine 10 and extending perpendicularly to the longitudinal dimension; conversely, the terms "inner", "inward" and derivatives thereof refer to the horizontal direction opposite the "outward" direction. Together, the "inward" and "outward" directions comprise the "transverse" dimension of the machine 10.

Referring again to FIG. 1, the machine 10 includes a frame 12, a movement arm unit 30, an upper leg-supporting assembly 50, a torso-supporting assembly 60, a conversion mechanism 70, a coupling unit 100, and a weight stack 110. These components and their interrelationships with one another are described in greater detail below.

The frame 12 includes a longitudinally extending base member 14 that is configured to rest on an underlying surface and to serve as the foundation for the frame 12. A front support 18 rises from the front end of the base member 14. A movement arm projection 22 is fixed to the upper end portion 20 of the front support 18 and extends upwardly and slightly forwardly therefrom. A rear support 16 extends upwardly and slightly forwardly from the rear end of the base member 14. The frame 12 also includes a conversion mechanism bracket 15 that is fixed to the base member 14 just rearwardly of the front support 18.

Those skilled in this art will recognize that the frame 12 illustrated herein is exemplary and can take many configurations that would be suitable for use with the present invention. The frame 12 provides a strong, rigid foundation to which other components can be attached at desired locations, and other frame forms able to serve this purpose may also be acceptable for use with this invention.

The movement arm unit 30 includes a leg extension assembly 32 and a leg curl assembly 40. The leg curl assembly 40 includes a curl swing arm 41 that is pivotally interconnected at one end with the upper end of the movement arm projection 22 at a pivot 48. At its opposite end, the swing arm 41 is attached to a transversely-extending curl engagement member 42, which is covered with a leg curl pad 44 that is engaged by an exerciser performing a leg curl movement. The leg extension assembly 32 includes an extension swing arm 33 that is fixed at one end to the curl swing arm 41 near the pivot 48; the joint between the curl swing arm 41 and the extension swing arm 33 is reinforced with a gusset 46. At its opposite end, the extension swing arm 33 is attached to a transversely-extending extension engagement member 34, which is covered with a leg extension pad 36 that is engaged by an exerciser performing a leg extension movement. A cable bracket 38 is attached to the rearward surface of the extension swing arm 33. Also, a front pulley bracket 24 extends rearwardly from a lower portion of the extension swing arm 33 and rests against the front surface of the front support 18.

Those skilled in this art will appreciate that the movement arm unit may take other forms and still be suitable for use with the present invention. For example, there may be separate leg extension members and leg curl assemblies, each with its own engagement member, pad and/or pivot axis, for each of the exerciser's legs, rather than having a single assembly with coincident pivot axes. Also, the attachment of the leg curl and leg extension swing arms 41, 33 to one another and to the movement arm extension 22 may vary. The cable bracket 38 may be attached to the curl swing arm 41 or to other locations on the movement arm assembly 30. Further, the leg curl and leg extension assemblies 40, 32 may each comprise a unitary member that serves as both the swing arm and the engagement member. Other variations may also be recognizable to those skilled in this art.

The upper leg-supporting assembly 50 includes a seat pad 52 that is supported from beneath by a seat support beam 54. The upper surface of the seat pad 52 defines a plane P. Grasping handles 55 (only one of which is shown herein) are mounted to the outer surfaces of the seat support beam 54 and are generally parallel to the seat pad 52. The seat support beam 54 is pivotally attached to the upper end portion 20 of the front support 18 at a pivot 58. The seat support beam 54 also includes a hinge tab 56 at its rearward end that extends beyond the rearward end of the seat pad 52.

The torso-supporting assembly 60 includes a backrest pad 62 that is supported from underneath by a backrest support beam 64. Grasping handles 63 (only one of which is shown herein) are mounted to the backrest support beam 64 and extend therefrom to be generally normal to the backrest pad 62. The backrest support beam 64 includes a hinge finger 66 at its forward end that extends upwardly and forwardly of the front end of the backrest pad 62. The hinge finger 66 is pivotally interconnected with the hinge tab 56 of the seat assembly 50 at a pivot 68 that enables the seat assembly 50 and backrest assembly 60 to pivot relative to each other. In addition, the backrest support beam 64 is pivotally interconnected with the upper end of the rear support 16 at a pivot 67. The torso-supporting assembly 60 further includes a ratchet-style adjustment unit 65 that enables the angle of the backrest pad 62 relative to the backrest support beam 64 to be adjusted; the backrest pad 62 is able to rotate about a pivot 61 located at the rearward end portions of the backrest pad 62 and backrest support beam 64.

Those skilled in this art will recognize that the upper leg-supporting assembly 50 and torso-supporting assembly 60 may take other configurations. For example, either or both may lack the grasping handles, or the adjustment unit 65 may differ in configuration or be omitted entirely. As another example, the seat and backrest pads 52, 62 may be supported by other types of support members. The pivot axes defined by the pivots 58, 61 and 67 may be positioned at different locations. Other alternatives will be recognized by those skilled in this art.

The conversion mechanism 70 includes a lifting member 72 and a control link 86 that combine with the base member 14, the front support 18, and the seat support 54 to form a four-bar linkage. The substantially straight lifting member 72 is pivotally interconnected at one end with the conversion mechanism bracket 15 at a pivot 76. A lifting handle 74 is mounted to the lifting member 72 and extends generally parallel thereto. The lifting member 72 also includes a collar (not shown) that receives a guide 80 (discussed below). A conversion pin (also not shown, and preferably spring-loaded) is also fixed to the lifting member 72 and extends inwardly therefrom.

At its end opposite the pivot 76, the lifting member is 72 pivotally interconnected with one end of the substantially straight control link 86 at a pivot 88. The control link 86 is pivotally interconnected at its other end to the seat support beam 54 at a pivot 90 located rearwardly of the pivot 58. A spring 92 is attached at one end to a central portion of the control link 86 and at its opposite end to the upper portion 20 of the front support 18; the spring 92 is in tension in the position shown in FIG. 1.

Figure 2:
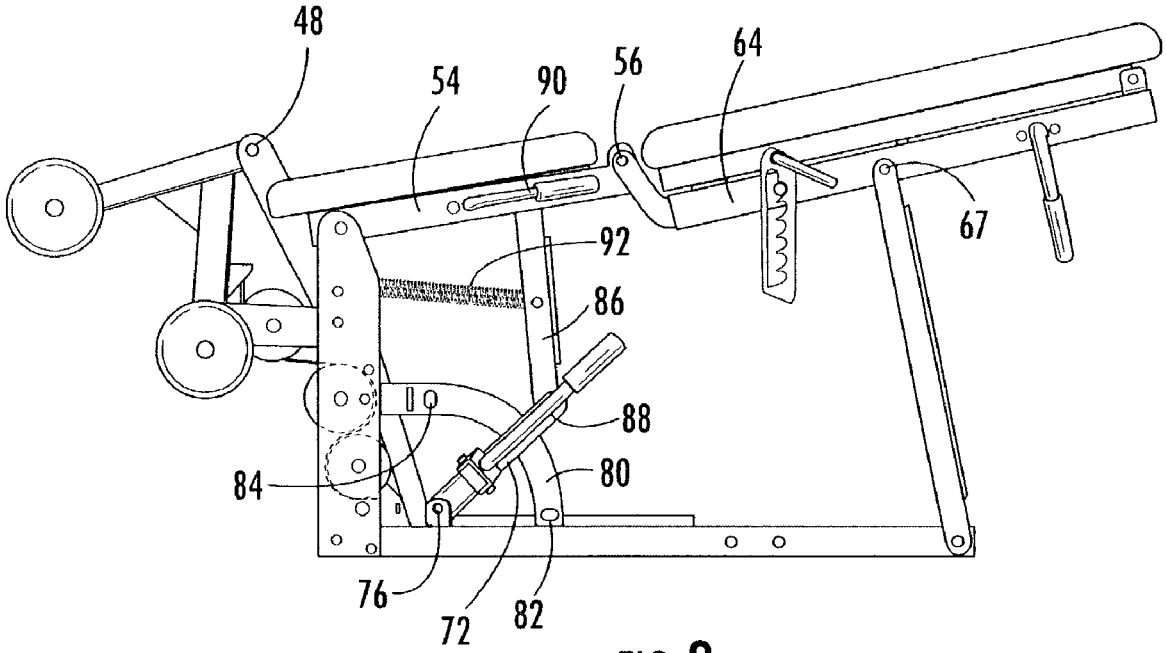
FIG. 2 is a side view of the leg curl/leg extension exercise machine of FIG. 1, with the machine shown moving between the leg extension and leg curl positions.

A guide 80 is fixed to the base member 14 rearwardly of the pivot 76 and arcs smoothly upwardly and forwardly to mount to the front support 18. The guide 80 is configured to allow the collar attached to the lifting member 72 to slide thereon as the lifting member 72 pivots about the pivot 76. The guide 80 includes a leg extension aperture 82 that is located near the base member 14 and a leg curl aperture 84 that is located near the front support 18; the apertures 82, 84 lock the lifting member 72 in position by therein receiving the conversion pin 78 (these are best seen in FIG. 2).

Those skilled in this art will recognize that conversion mechanisms of other configurations may be used with the machine 10. For example, the control link may be attached to the torso-supporting assembly rather than to the upper leg-supporting assembly, and the lifting link may be attached to the frame at a more rearward location. Also, the guide (and, in turn, the collar) may be omitted, and other components, such as stop pins and the like, that cause the conversion mechanism to cease movement as the machine reaches the leg curl and/or leg extension positions may be included. In addition, the lifting and control links may take other configurations that retain the same geometry of pivots as described above, or may take a different geometry that enables the upper leg-supporting assembly and the torso-supporting assembly, while hinged together, to move between the leg extension and leg curl positions.

Referring again to FIG. 1, the movement arm assembly 30 is coupled to the weight stack 110 via a pulley train 100. The pulley train 100 includes a cable 102 that is fixed to the cable bracket 38 on the extension swing arm 33. The cable 102 travels rearwardly below a guide pulley 104*a* mounted to the front pulley bracket 24, above and rearwardly of a guide pulley 104*b* mounted to the front support 18, and below and forwardly of a guide pulley 104*c*. The cable 102 then travels rearwardly to a lower pulley 106, upwardly to a first transitional pulley 108*a*, forwardly to a second transitional pulley 108*b*, and downwardly to the weight stack 100. Of course, the pulley train 100 may take many configurations known to those skilled in this art that can provide resistance to the movement of the movement arm assembly 30.

Figure 4:
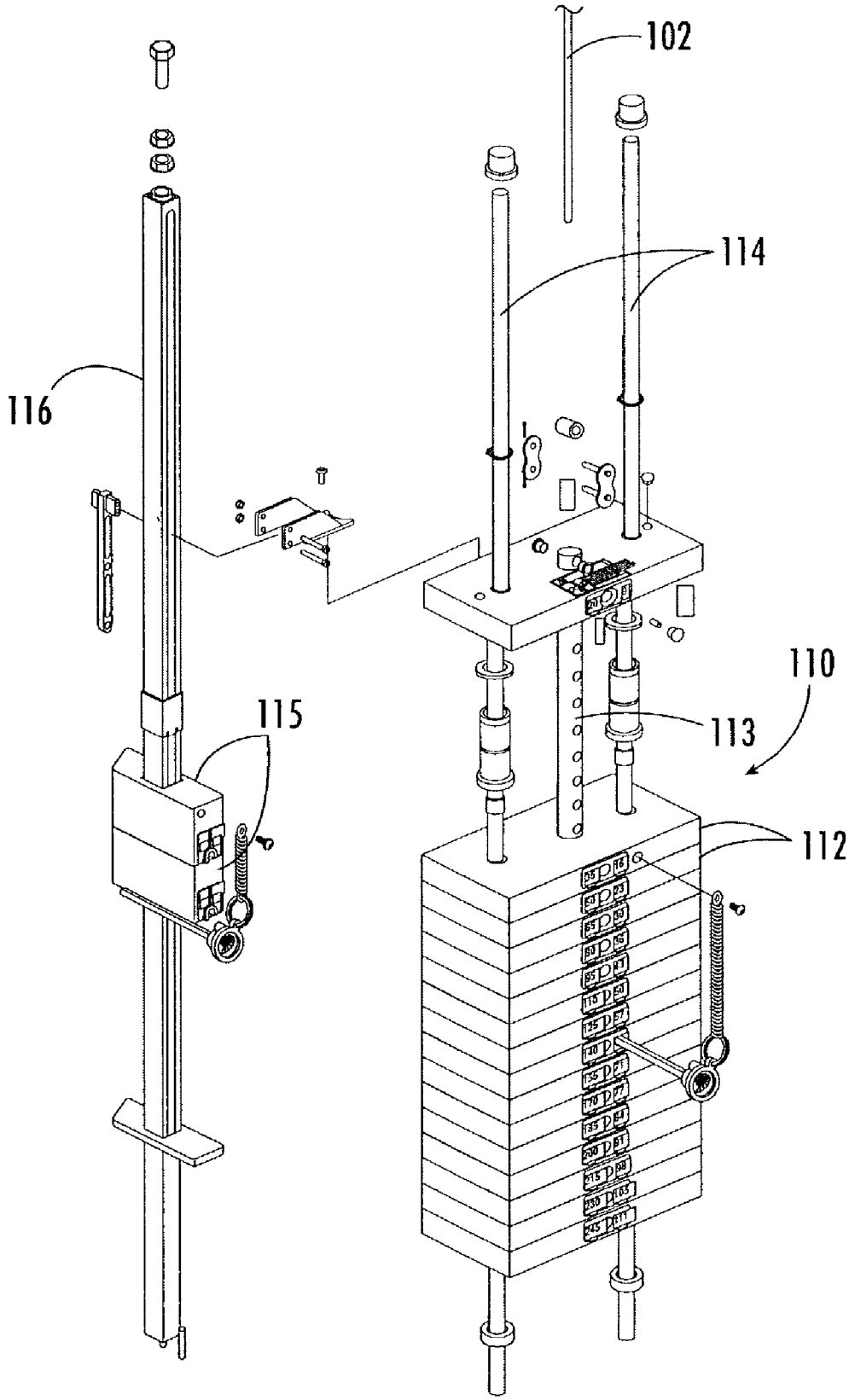
FIG. 4 is an enlarged, exploded, perspective view of the weight stack of the exercise machine of FIG. 1.

Referring now to FIG. 4, the weight stack 110 includes a set of weights 112 arranged in a vertical stack just above a base portion of the frame 12 (not shown). A lifting rod 113 extends vertically through apertures in the weights 112 and is configured to receive a pin inserted between individual weights 112 that enables the user to select the number of weights to be used in the exercise. The weight stack 110 also includes guide rods 114 that extend vertically through the weights 112 to guide the weights 112 along a vertical path during exercise. Weight stacks of this variety are well known to those skilled in this art and need not be described in detailed herein. In addition, the machine 10 may include a set of auxiliary weights 115 that slide along a vertical guide rod 116 and that can be temporarily connected with the selected weights to provide incremental weight during exercise. Again, auxiliary weight systems of this type are well known to those skilled in this art and need not be described in detail herein. An exemplary machine having such a weight stack is a leg extension machine available from Nautilus HPS, Inc. (Independence, Va.) under the trade name NITRO™.

Those skilled in this art will recognize that, although a weight stack is the preferred structure for providing resistance to the exerciser, other resistance-imparting structures, such as friction-imparting devices, variable viscosity devices, air drag-based resistance devices, and the like, may also be employed with a leg curl/leg extension machine of the present invention. Exemplary resistance devices include those illustrated in U.S. Pat. Nos. 5,810,096, 4,708,338; 4,720,093; 5,033,733; 4,542,897; 4,298,893; 4,805,901; 4,790,528; 4,786,049; 5,031,900; 4,775,145; 4,589,656; and 4,659,074, the disclosures of each of which are hereby incorporated herein by reference in their entireties.

The machine 10 can be operated in either the leg extension (FIG. 1) or leg curl (FIG. 3) mode. For the leg extension movement, the machine 10 is in the position shown in FIG. 1, in which the seat pad 52 and the backrest pad 62 form a backrest and seat for the seated exerciser (typically, the angle $\alpha 1$ between the seat pad 52 and the backrest pad 62 is between about 100 and 120 degrees). In the leg extension position of FIG. 1, the lifting member 72 of the conversion mechanism 70 is generally horizontal, such that the conversion pin is received in the leg extension slot 82. The control link 86 extends upwardly and slightly forwardly from the pivot 88 to the pivot 90. The spring 92 extends upwardly and forwardly from its attachment point with the control link 86 and is in tension.

To perform the leg extension movement, the exerciser adjusts the backrest pad 62 to the desired position, then selects the desired number of weights 112 to provide the desired resistance. He then sits on the seat pad 52 with his back against the backrest pad 62 and bends his knees in order to place his feet below the leg extension pad 36 so that it engages his ankles (optionally, the exerciser may grasp the handles 55 for support). The leg extension movement is carried out by the exerciser straightening his legs. This action causes the movement arm unit 30 to pivot about the pivot 48; this movement is resisted by the weights 112, which are coupled to the movement arm unit 30 by the cable 102. The leg extension movement ceases when the exerciser's legs are straight (in the illustrated embodiment, this would occur as the leg extension pad 36 is positioned above the front edge of the seat pad 52). The leg extension movement primarily exercises the quadriceps muscles of the exerciser.

Notably, as the exerciser is seated on the seat pad 52, the exerciser's knees are virtually aligned with the pivot 48 along a transverse pivot axis Al, which is located in front of the front edge of the seat pad 52 (typically between about 0.25 and 1.5 inches in front of the front edge) and slightly below or substantially parallel with the plane P defined by the upper surface of the seat pad 52. As such, the exerciser is positioned such that the pivot axis A1 is substantially coincident with the exerciser's knee joints, which can result in more efficient exercise with less risk of stress on the knee joints.

The machine 10 can then be converted from the leg extension mode of FIG. 1 to the leg curl mode (see FIG. 3) through operation of the conversion mechanism 70. To achieve this conversion, initially the conversion pin 78 is released from the leg extension slot 82. The user can then grasp the handle 74 and lift, thereby drawing the rear end of the lifting member 72 upwardly and forwardly about the pivot 76 (this movement is guided by the guide 80). The rotation of the lifting member 74 drives the control link 86 upwardly and draws its lower end forwardly. Contraction of the spring 92 as the control link 86 rises and rotates provides assistance in the conversion movement. The elevation of the control link 86 forces the seat assembly 50 to rotate about the pivot 58 such that the rearward end of the seat pad 52 rises (this rotation is counterclockwise from the vantage point of FIGS. 1–3). Rotation of the seat assembly 50 causes the backrest assembly 60 to rotate about the pivot 67 such that the pivot 68 rises (the rotation of the backrest assembly 60 is clockwise from the vantage point of FIGS. 1–3).

The conversion movement ceases when the conversion pin 78 reaches the leg curl slot 84 and is received therein. At this point, the seat pad 52 slopes upwardly from front to rear (an angle of between about 10 and 30 degrees with the underlying surface is typical), and the backrest pad 62 is generally horizontal, such that the angle $\alpha 2$ between the seat pad 52 and backrest pad 62 is between about 150 and 170 degrees.

Figure 3:
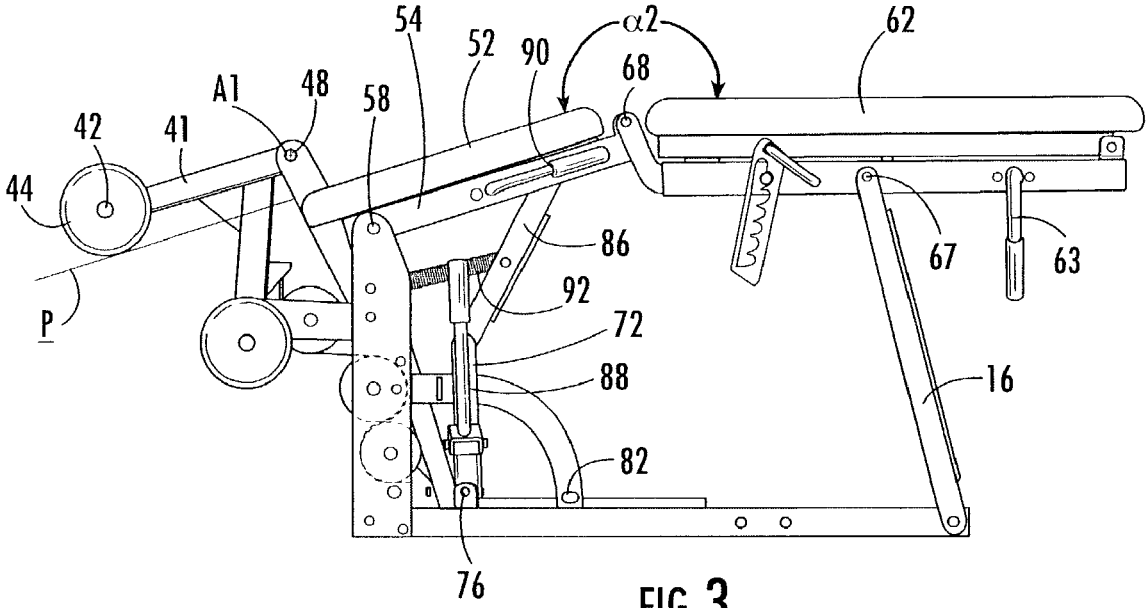
FIG. 3 is a side view of the leg curl/leg extension exercise machine of FIG. 1, with the machine shown in its leg curl position.

Once the machine 10 is moved to the leg curl mode of FIG. 3, the exerciser is free to perform the leg curl movement. Initially, the exerciser adjusts the position of the backest pad 62 and selects a desired number of weights 112. The exerciser performs the leg curl movement by lying face down on the seat and backrest pads 52, 62, with his torso on the backrest pad 62, his upper thighs on the seat pad 52, his knees just positioned just forwardly of the front edge of the set pad 52, and his ankles below and engaging the leg curl pad 44. Optionally, the exerciser may grasp the handles 63 for support. Exercise proceeds with the exerciser bending his legs at the knees to draw the leg curl pad 44 upwardly and rearwardly as the movement arm assembly 30 pivots around the pivot 48. Resistance to this movement is provided by the selected weights 112 as they rise in response to movement of the cable 102. The leg curl movement ceases as the exerciser fully flexes his legs; this movement primarily exercises the hamstring and gluteal muscles of the exerciser.

As illustrated in FIG. 3, when the exerciser is in position on the machine 10, the exerciser's knee joint is substantially aligned with the pivot axis A1 that extends transversely through the pivot 48. As a result, the leg curl movement places little stress on the exerciser's knee joints. Preferably, the pivot axis A1 is positioned between about 2 and 4 inches above the plane P defined by the upper surface of the seat pad 52.

Those skilled in this art will appreciate that, although the leg press machine 10 is illustrated as a "stand-alone" machine, it can be incorporated as a station into a multi-station exercise machine, such as that available from Nautilus HPS, Inc. under the trade name PERSONAL CIRCUIT. In such a machine, the leg curl/leg extension station may have its own weight stack or, more typically, may share its weight stack with one or more stations. The ordinarily skilled artisan will understand the modifications to the leg curl/leg extension machine of the present invention that may be needed in order that the leg curl/leg extension station be utilized within a multi-station exercise machine.

The foregoing demonstrates that exercise machines of the present invention can provide leg curl and leg extension motion with desirable characteristics, such as preferred positioning of the movement arm pivot axis for both leg curl and leg extension movements, and can provide these characteristics in a single exercise machine or exercise station that is easily converted between configurations for each exercise movement.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An exercise machine for performing leg curl and leg extension movements, comprising:

a frame configured to rest on an underlying surface;

an upper leg-supporting assembly pivotally interconnected with the frame, the upper leg supporting assembly having a seat pad;

a torso-supporting assembly pivotally interconnected with the frame and with the upper leg-supporting assembly, the torso-supporting assembly having a backrest pad;

a leg curl assembly arm pivotally interconnected with the frame about a first pivot axis;

a leg extension assembly arm pivotally interconnected with the frame about a second pivot axis;

a resistance-imparting unit coupled with the leg curl movement arm and the leg extension movement arm; and a conversion mechanism interconnected with the frame and at least one of the torso-supporting assembly and the upper leg-supporting assembly, the conversion mechanism being configured to move the torso-supporting assembly and the upper leg-supporting assembly between a leg extension position, in which the seat pad and the backrest pad combine to form a backrest and seat for a seated exerciser, and in which the second pivot axis is positioned in front of a front edge of the seat pad, and a leg curl position, in which the seat pad and backrest pad combine to form a curl platform for a prone exerciser, and in which the first pivot is positioned above a plane defined by an upper surface of the seat pad.

2. The exercise machine defined in claim 1, wherein the first pivot axis and the second pivot axis are coincident.

3. The exercise machine defined in claim 1, wherein the first pivot axis is positioned between about 2 and 4 inches above the plane defined by the seat pad when the exercise machine is in the leg curl position.

4. The exercise machine defined in claim 1, wherein the second pivot axis is positioned between about 0.25 and 1 inches in front of the front edge of the seat pad when the exercise machine is in the leg extension position.

5. The exercise machine defined in claim 1, wherein in the leg curl position, the platform defined by the backrest pad and the seat pad forms an angle of between about 150 and 170 degrees.

6. The exercise machine defined in claim 5, wherein in the leg extension position, the backrest pad and the seat pad define an angle of between about 100 and 120 degrees.

7. The exercise machine defined in claim 1, wherein the resistance-imparting mechanism includes a weight stack.

8. The exercise machine defined in claim 1, wherein the conversion mechanism comprises:

a lifting member pivotally interconnected to the frame; and a control link pivotally interconnected to the lifting member and to the upper leg-supporting assembly.

9. The exercise machine defined in claim 8, wherein the conversion mechanism further comprises:

a conversion pin attached to the lifting member; and a guide attached to the frame, the guide including a leg extension slot and a leg curl slot positioned such that, when the exercise machine is in the leg extension position, the conversion pin is received in the leg extension slot, and when the exercise machine is in the leg curl position, the conversion pin, is in the leg curl slot.

10. The exercise machine defined in claim 8, wherein the conversion mechanism includes a handle attached to the lifting member.

11. The exercise machine defined in claim 1, wherein the torso-supporting assembly includes a support member that underlies the backrest pad, and wherein the backrest pad is pivotable relative to the support member.

12. An exercise machine for performing leg curl and leg extension movements, comprising:

a frame configured to rest on an underlying surface;

an upper leg-supporting assembly pivotally interconnected with the frame, the upper leg supporting assembly having a seat pad;

a torso-supporting assembly pivotally interconnected with the frame and with the upper leg-supporting assembly, the torso-supporting assembly having a backrest pad;

a movement arm unit pivotally attached to the frame at a first pivot axis, the movement arm unit including a leg curl movement arm and a leg extension movement arm;

a resistance-imparting unit coupled with the leg curl movement arm and the leg extension movement arm; and a conversion mechanism interconnected with the frame and at least one of the torso-supporting assembly and the upper leg-supporting assembly, the conversion mechanism being configured to move the torso-supporting assembly and the upper leg-supporting assembly between a leg extension position, in which the seat pad and the backrest pad combine to form a backrest and seat for a seated exerciser, and a leg curl position, in which the seat pad and backrest pad combine to form a curl platform for a prone exerciser, the conversion mechanism comprising a lifting member pivotally interconnected to the frame; and a control link pivotally interconnected to the lifting member and to the upper leg-supporting assembly;

wherein in the leg extension position, the first pivot axis is positioned in front of a front edge of the seat pad, and in the leg curl position, the first pivot is positioned above a plane defined by an upper surface of the seat pad; and wherein in the leg curl position, the curl platform defined by the backrest pad and the seat pad forms an angle of between about 150 and 170 degrees.

13. The exercise machine defined in claim 12, wherein the first pivot axis is positioned between about 2 and 4 inches above the plane defined by the seat pad when the exercise machine is in the leg curl position.

14. The exercise machine defined in claim 12, wherein the first pivot axis is positioned between about 0.25 and 1 inches in front of the front edge of the seat pad when the exercise machine is in the leg extension position.

15. The exercise machine defined in claim 12, wherein in the leg extension position, the backrest pad and the seat pad define an angle of between about 100 and 120 degrees.

16. The exercise machine defined in claim 12, wherein the resistance-imparting mechanism includes a weight stack.

17. The exercise machine defined in claim 12, wherein the conversion mechanism further comprises:

a conversion pin attached to the lifting member; and a guide attached to the frame, the guide including a leg extension slot and a leg curl slot positioned such that, when the exercise machine is in the leg extension position, the conversion pin is received in the leg extension slot, and when the exercise machine is in the leg curl position, the conversion pin is in die leg curl slot.

18. The exercise machine defined in claim 12, wherein the conversion mechanism includes a handle attached to the lifting member.

19. An exercise machine for performing leg curl and leg extension movements, comprising:

a frame configured to rest on an underlying surface;

an upper leg-supporting assembly pivotally interconnected with the frame, the upper leg supporting assembly having a seat pad;

a torso-supporting assembly pivotally interconnected with the frame and wit the upper leg-supporting assembly, the torso-supporting assembly having a backrest pad;

a movement arm assembly pivotally attached to the frame at a first pivot axis, the movement arm assembly including a leg curl movement arm and a leg extension movement arm;

a resistance-imparting unit coupled with the leg cud movement aim and the leg extension movement arm; and a conversion mechanism interconnected with the frame and at least one of the torso-supporting assembly and the upper leg-supporting assembly, The conversion mechanism being configured to move the torso-supporting assembly and the upper leg-supporting assembly between a leg extension position, in which the seat pad and the backrest pad combine to form a backrest and seat for a seated exerciser, and a leg curl position, in which the seat pad and backrest pad combine to form a curl platform for a prone exerciser, the conversion mechanism comprising a lifting member pivotally interconnected to the frame; and a control link pivotally interconnected to the lifting member and to the upper leg-supporting assembly;

wherein the first pivot axis is positioned between about 2 and 4 inches above a plane defined by the seat pad when the exercise machine is in the leg curl position, and wherein the first pivot axis is positioned between about 0.25 and 1 inches in front of a front edge of the seat pad when the exercise machine is in the leg extension position.

20. The exercise machine defined in claim 19, wherein in the leg curl position, the platform defined by the backrest pad and the seat pad form an angle of between about 150 and 170 degrees.

21. The exercise machine defined in claim 19, wherein in the leg extension position, the backrest pad and the seat pad define an angle of between about 100 and 120 degrees.

22. The exercise machine defined in claim 19, wherein the resistance-imparting mechanism includes a weight stack.

23. The exercise machine defined in claim 19, wherein the conversion mechanism further comprises:

a conversion pin attached to the lifting member; and a guide attached to the frame, the guide including a leg extension slot and a leg curl slot positioned such that, when the exercise machine is in the leg extension position, the conversion pin is received in the leg extension slot, and when the exercise machine is in the leg curl position, the conversion pin is in the leg curl slot.

24. The exercise machine defined in claim 19, wherein the conversion mechanism includes a handle attached to the lifting member.

25. An exercise machine for performing leg curl and leg extension movements, comprising:

a frame configured to rest on an underlying surface;

an upper leg-supporting assembly pivotally interconnected with the frame, the upper leg supporting assembly having a seat pad;

a torso-supporting assembly pivotally interconnected with the frame and with the upper leg-supporting assembly, the torso-supporting assembly having a backrest pad;

a movement arm assembly pivotally attached to the frame at a first pivot axis, the movement inn assembly including a leg curl movement arm and a leg extension movement arm;

a resistance-imparting unit coupled with the leg curl movement arm and the leg extension movement arm; and a conversion mechanism interconnected with the frame and the upper leg-supporting assembly, the conversion mechanism being configured to move the torso-supporting assembly and the upper leg-supporting assembly between a leg extension position, in which the seat pad and the backrest pad combine to form a backrest and seat for a seated exerciser, and a leg curl position, in which the seat pad and backrest pad combine to form a curl platform for a prone exerciser, the conversion mechanism comprising:

a lifting member pivotally interconnected to the frame;

a control link pivotally interconnected to the lifting member and to the upper leg-supporting assembly;

a conversion pin attached to the lifting member; and a guide attached to the frame, the guide including a leg extension slot and a leg curl slot positioned such that, when the exercise machine is in the leg extension position, the conversion pin is received in the leg extension slot, and when the exercise machine is in the leg curl position, the conversion pin is in the leg curl slot.

26. An exercise machine for performing leg curl and leg extension movements, Comprising:

a frame configured to rest on an underlying surface;

an upper leg-supporting assembly pivotally interconnected with the frame, the upper leg supporting assembly having a seat pad;

a torso-supporting assembly pivotally interconnected with the frame and with the upper leg-supporting assembly, the torso-supporting assembly having a backrest pad;

a leg curl assembly arm pivotally interconnected with the frame about a first pivot axis;

a leg extension assembly arm pivotally interconnected with the frame about a second pivot axis;

a resistance-imparting unit coupled with die leg curl movement arm and the leg extension movement arm; and a conversion mechanism interconnected with the frame and at least one of the torso-supporting assembly and the upper leg-supporting assembly, the conversion mechanism being configured to move die torso-supporting assembly and the upper leg-supporting assembly between a leg extension position, in which the seat pad and the backrest pad combine to form a backrest and seat for a seated exerciser, and in which the second pivot axis is positioned in front of a front edge of the seat pad, and a leg curl position, in which the seat pad and backrest pad combine to form a curl platform for a prone exerciser, and in which the first pivot is positioned above a plane defined by an upper surface of the seat pad;

wherein in the leg curl position, the platform defined by the backrest pad and the seat pad forms an angle of between about 150 and 170 degrees; and wherein in the leg extension position, the backrest pad and the seat pad define an angle of between about 100 and 120 degrees.

* * * * *

UNITED STATES PATENT AND TRADEMARK OFFICE

CERTIFICATE OF CORRECTION

PATENT NO. : 7,150,702 B2
APPLICATION NO. : 10/186433
DATED : December 19, 2006
INVENTOR(S) : Gregory M. Webb et al.

It is certified that error appears in the above-identified patent and that said Letters Patent is hereby corrected as shown below:

Column 10,

Line 56, change “wit” to read --with--

Line 62, change “cud” to read --curl--

Line 63, change “aim” to read --arm--

Column 11,

Line 38, check dependency

Line 51, change “inn” to read --arm--

Column 12,

Line 22, change “Comprising” to read --comprising--

Line 35 and 41 change “die” to read --the--

Signed and Sealed this

Thirteenth Day of March, 2007

JON W. DUDAS
*Director of the United States Patent and Trademark Office*